US005782198A

United States Patent [19]

Sinclair, II et al.

[11] Patent Number: 5,782,198

[45] Date of Patent: Jul. 21, 1998

[54] AUDIBLE WARNING DEVICE

[76] Inventors: Paul Sinclair, II, 153 Harbourton-Woodsville Rd., Lambertville, N.J. 08530; John P. Meloney, 164 Upper Ferry Rd., Trenton, N.J. 08628

[21] Appl. No.: 682,986

[22] Filed: Jul. 16, 1996

[51] Int. Cl.[6] ..... G10K 9/04

[52] U.S. Cl. ..... 116/139; 116/142 FP

[58] Field of Search ..... 116/139, 142 R, 116/142 FP; 222/402

[56] References Cited

U.S. PATENT DOCUMENTS

| | | | |
|---|---|---|---|
| 261,343 | 7/1882 | Hansen | 116/139 |
| 436,651 | 9/1890 | Dyer | 116/139 |
| 830,395 | 9/1906 | Wilson | 116/139 |
| 1,250,078 | 12/1917 | Barkman | 222/401 |
| 2,544,854 | 3/1951 | Oys et al. | 222/402 |
| 3,785,335 | 1/1974 | Wagner | 116/112 |
| 4,185,670 | 1/1980 | Sartell, Jr. | 141/94 |
| 4,970,983 | 11/1990 | LeBlanc et al. | 116/142 |
| 5,355,830 | 10/1994 | deJong | 116/142 |

FOREIGN PATENT DOCUMENTS

| | | | |
|---|---|---|---|
| 1084254 | 1/1955 | France | 116/139 |

*Primary Examiner*—William A. Cuchlinski, Jr.
*Assistant Examiner*—Willie Morris Worth
*Attorney, Agent, or Firm*—Duane, Morris & Heckscher LLP

[57] ABSTRACT

The inventive audible warning device includes, in a preferred embodiment, a refillable pressurized air tank having a service port, a cover for covering the service port, an air pump integrated with the tank for filling the tank within pressurized air, an activator for regulating air flow, a hose connecting the tank to the activator, and a horn connected to the activator. The cover also includes a relief valve for depressurizing the tank. In addition, the cover includes locking elements for locking the cover, which can include in turn a rotatable handle that triggers the relief valve when the locking elements are unlocked. A method for producing sound is also disclosed herein.

18 Claims, 5 Drawing Sheets

AUDIBLE WARNING DEVICE

FIELD OF THE INVENTION

The present invention relates to audible warning devices and, more particularly, to portable self-contained audible warning devices for use in industry.

BACKGROUND OF THE INVENTION

Audible warning devices are used in industry to warn of possible hazards. For example, a "look-out" person can use such device to warn others of a coming train. Similarly, warning devices can be used to signal that a mining drill is in operation, etc.

Several prior art warning devices include horns connected to a container generally containing chemical gases which act as a propellant. Such devices are generally shown and described in U.S. Pat. Nos. 3,785,335 and 4,970,983.

Chemical liquids which are used as precursors of gaseous propellant in a horn, however, generate frosty temperatures when used. A safety hazard can result when sounding the horn since the flowing gases can condense on the user's skin, causing frostbite or irritation. Sometimes a small amount of liquid can also flow out the horn. As a result, a user may potentially suffer from frostbite when the liquid contacts his body. This may be especially prevalent when the container is not held in a vertical, upright position.

In addition, chemically propelled horns, when sounded repetitively over a short time span, may stop working as a result of cold gases freezing the membrane of the horn. Narrow air passages may cause pressure of the gases flowing through the entire unit to decrease as well. Therefore, the reliability of the horn for repetitive use over a short time span is hampered. Accordingly, the duration and number of possible warning signals a user can sound to warn others can be severely limited. In addition, the described reliability problems are unacceptable when attempting to warn others of a great danger.

Another drawback of chemically propelled horns is that they generally operate only in temperatures above 33° F. While this temperature range may not be critical for sports fans using the horns during a game, it is not acceptable for industrial warning uses, as crews sometimes work in extreme circumstances, including below-freezing temperatures.

In addition, known chemically propelled horns have used chlorofluoro-carbon (CFC) as a propellant. CFCs are notoriously destructive to the ozone layer and are currently subject to strict environmental regulations. Some "environment-friendly" gases are known to be used in chemically propelled horns, but these gases are typically costly, highly flammable, and often extremely dangerous in industrial settings where sparks and open flames are not unusual occurrences.

Most models of chemically propelled are not capable of being refilled for reuse. Instead, when the gases are depleted from the container, the container must be thrown away and replaced. Sometimes the discarded containers are hazardous themselves, and need to be disposed safely, and kept away from open flame.

Some of these problems have been recognized by people skilled in other fields of art. Some artisans have proposed solutions that solve the specific problems within their respective fields.

For example, U.S. Pat. Nos. 4,185,670 and 5,355,830 propose refillable air horns for use by bicyclists. They are lightweight, inexpensive horns for recreational use and are not designed to withstand heavy-duty field use.

In addition, the preferred embodiments of these "recreational horns" require the use of an external air source, such as an air pump or a compressed gas source, which could be lost or forgotten. Industry users may find this requirement to be unacceptable, especially when they must immediately warn others of a danger without a nearby air source.

Further, such recreational horns do not have safety features to avoid the risk of excess pressure accidents. For example, if a person overpressurizes a gas container and leaves it out in the heat, the container may explode due to the expanding gas, possibly causing injury to others. Industry users may find this risk to be unacceptable.

Additionally, an industrial worker cannot depressurize the container of the recreational horns without sounding the horn. This would cause a false alarm which would delay further work.

Finally, the described recreational horns cannot be easily serviced or maintained. Industry users would prefer an audible warning device that can be easily serviced and maintained to ensure use throughout extended periods of time.

SUMMARY OF THE INVENTION

The present invention provides an audible warning device which overcomes the deficiencies of known prior art devices. In a first embodiment of this audible warning device, a refillable pressurized air tank is provided having a service port, a cover for covering the service port, an air pump integrated with the tank for filling the tank with pressurized air, an activator for regulating air flow, means for connecting the tank to the activator, and a horn connected to the activator.

Several benefits arise from providing such audible warning device. First, because ambient air is used instead of chemical liquids to sound the horn, the inventive device disclosed herein is safer to use than prior art devices. For example, the risk of suffering frostbite due to the operation of the device is eliminated.

In addition, the risk of freezing the membrane of the horn due to the temperature of the propellant is also low. Accordingly, the audible warning device disclosed herein can be reliably used in temperatures below 33° F.

Further, unlike the prior art devices, the tank need not be disposed of once it is emptied. Instead, the tank can be refilled via the integrated pump. Industry users will recognize that, unless the pump is detached from the tank, the odds of forgetting or losing the pump are insignificant.

Finally, the provided cover allows maintenance and service of the inventive audible warning device. This would permit use of the inventive device for extended periods of time.

In a preferred embodiment of the inventive audible warning device, the cover can also include a relief valve for depressurizing the tank. In addition, the cover can include locking means for locking the cover, which includes, in turn, a rotatable handle that triggers the relief valve when the locking means is unlocked. Accordingly, a user can depressurize the tank without sounding the horn, lessening the risk of explosion due to overpressure.

A method for producing an audible warning sound is also disclosed herein. A preferred embodiment of this method includes the step of providing an audible warning device comprising a refillable pressurized air tank having a service port, a cover for covering the service port, an air pump integrated with the tank for filling the tank with pressurized air, an activator for regulating air flow from the tank, means for connecting the tank to the activator, a horn connected to the activator to receive a portion of the pressurized air so as to be activated to produce an audible warning. In addition, the method further includes the steps of filling the tank with pressurized air, depressing the activator for releasing the pressurized air into the horn thereby producing the audible warning sound, refilling the tank after the pressurized air has been at least partially depleted therefrom, and removing the cover for servicing the audible warning device.

The method may also include the steps of providing a relief valve for depressurizing the tank, and opening the relief valve for releasing the pressurized air without producing an audible warning sound.

Persons skilled in the art will recognize that the inventive method shares some of the advantages and benefits obtained with the inventive audible warning device.

Additional features and benefits of the present invention are described, and will be apparent from, the accompanying drawings and the detailed description below.

BRIEF DESCRIPTION OF THE DRAWINGS

The accompanying drawings illustrate preferred embodiments of the invention according to the practical application of the principles thereof, and in which.

DETAILED DESCRIPTION

Figure 1:
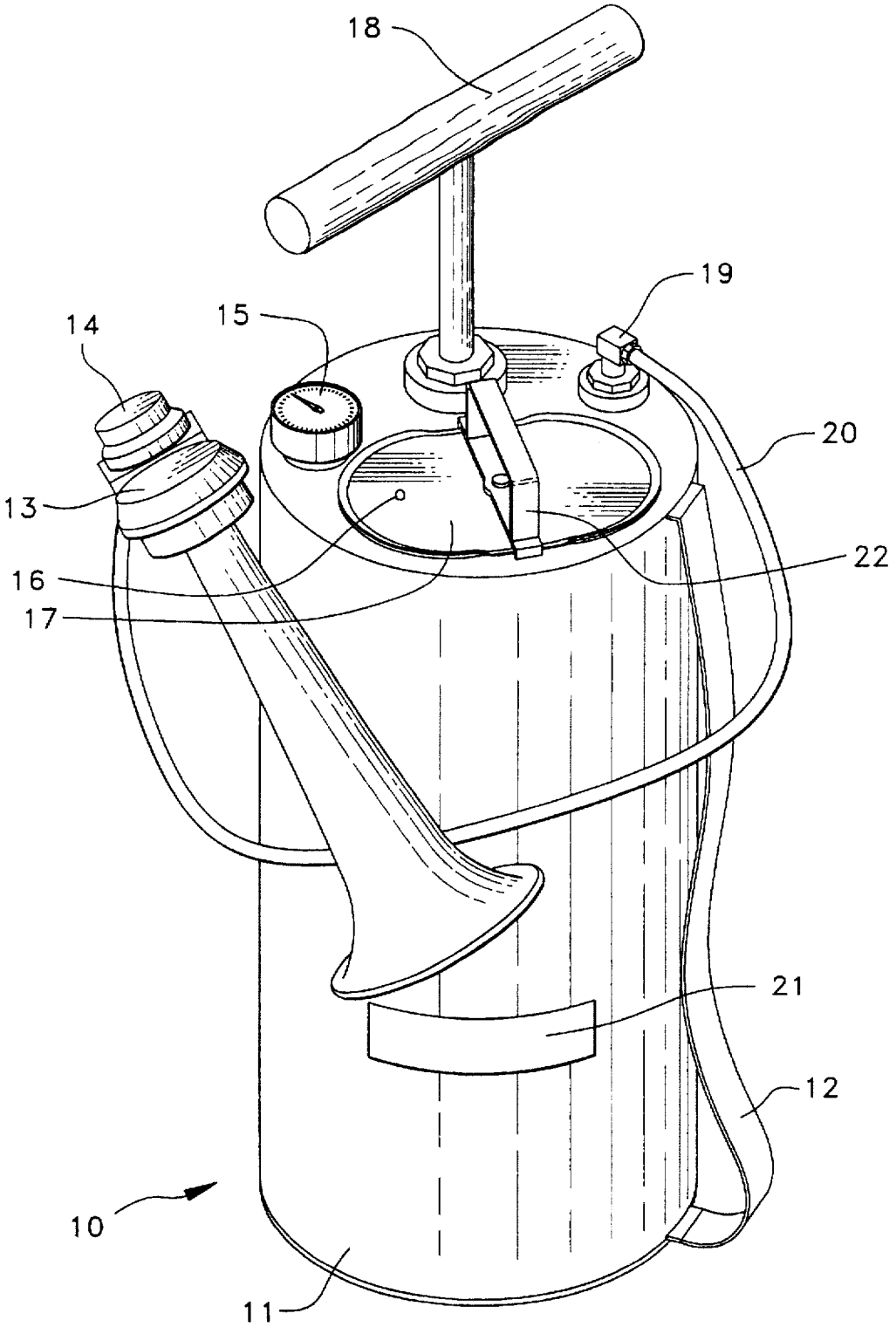
FIG. 1 is a perspective view of the audible warning system of the present invention.

The invention is now described with reference to the accompanying figures wherein like numerals designate like parts. Referring to FIG. 1, a preferred audible warning device 10 is provided for dispensing compressed air stored within a tank 11 through a horn 13. Depressing an activator 14 allows the air stored within the tank to escape through the hose 20, the activator 14 and finally the horn 13. Once the tank 11 is emptied, a person can pump ambient air into the tank 11 by actuating a built-in pump (not shown in FIG. 1) via pump handle 18.

As used herein, the term "lock" means to engage together closely. In addition, the terms "couple" or "connect" mean to form a mechanical link or bond between two elements, wherein the link allows air flow through the elements.

The tank 11 is preferably made of stainless steel, brass, bronze or another corrosion resistant strong metal that can withstand the abuse of industrial field use. In addition, the preferred tank has several ports to accommodate different items, as discussed below. A suitable tank may be purchased from H. D. Hudson Manufacturing Company, 533 North Michigan Avenue, Chicago, Ill. 60611, as part of Item Number 93794 SS.

Figure 2:
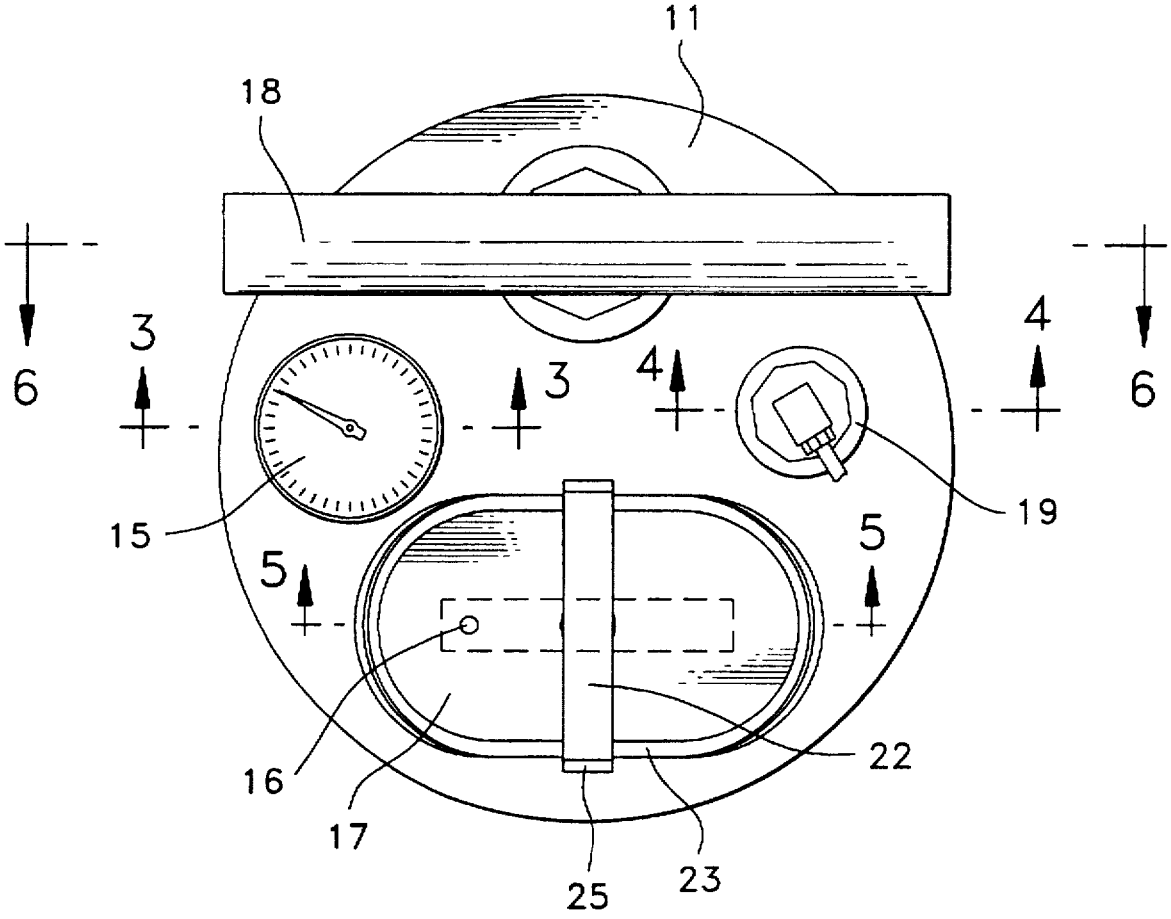
FIG. 2 is a top view of the audible warning system of FIG. 1.
Figures 3, 4, 5:
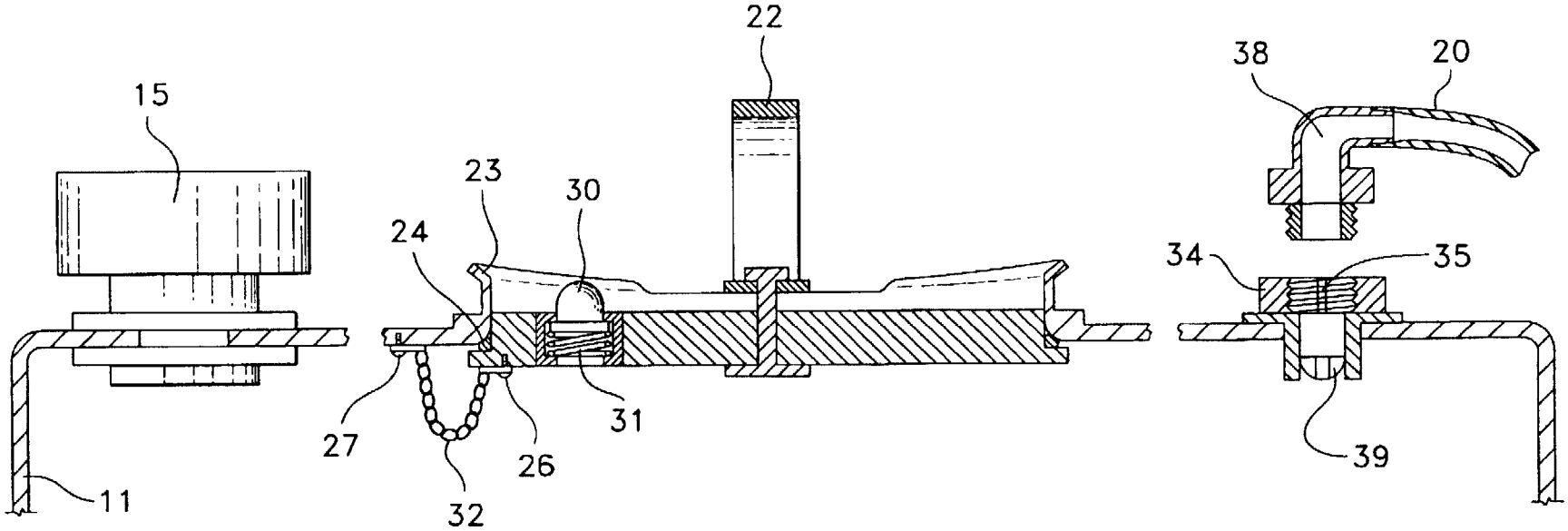
FIG. 3 is a front partial cross-sectional view along line 3—3 of FIG. 2.
FIG. 4 is a front cross-sectional view along line 4—4 of FIG. 2.
FIG. 5 is a front cross-sectional view along line 5—5 of FIG. 2.

Referring to FIGS. 1–2 and 4, the preferred audible warning device 10 also has a cover 17 that provides easy access for maintaining and servicing the elements inside the tank 11. Preferably, the cover 17 has a rotatable handle 22 that locks the cover 17 in place. FIG. 2 shows handle 22 in the locked position with solid lines and in the unlocked position with broken lines.

The handle 22 locks the cover 17 by engaging the tank lips 23 via the handle ends 25. The lips 23 are designed so that they become substantially horizontal where the ends 25 would engage the lips 23 in the locked position and become substantially vertical elsewhere, so that the ends 25 can disengage the lips 23.

Accordingly, when the handle 22 is rotated towards the locked position, the ends 25 expand slightly along the substantially horizontal lips 23, thus lifting the cover 17. As shown in FIG. 4, when the cover is lifted, the rubber gasket 24 is crushed, sealing the cover 17. Conversely, when the handle 22 is rotated towards the unlocked position, the ends 22' contract slightly and disengage the substantially vertical lips 23, unlocking the cover 17.

A person skilled in the art will recognize that other locking means may be utilized to achieve the same purpose. These are considered equivalent to the disclosed means. Nevertheless, it may be beneficial to incorporate a handle into the locking means or to provide a handle elsewhere within the tank 11, providing users with an ergonomic grasp.

Preferably, the cover 17 also has a relief valve 16, which allows depressurization of the tank 11, lessening any possible risk of overpressure and explosion. As shown in FIG. 4, the relief valve 16 includes a spring loaded pin 30 that can be depressed so that air escapes through the newly opened channel. Once pressure on the pin 30 is released, the spring 31 forces the pin 30 back into the closed position, thus closing the channel.

Having the relief valve 16 on the cover 17 is convenient for several reasons. First, since the cover 17 is located at the top end of the audible warning device 10, the relief valve is easily accessible to a user yet unlikely to be triggered during transportation of the audible warning device 10. In addition, as shown in FIG. 2, the rotatable handle 22 triggers the relief valve 16 when the handle 22 is rotated towards the unlocked position. Thus, a user can open the audible warning device 10 safely.

A chain 32 may be affixed at one end to the cover 17 via a screw 26, and at the other end to the tank 11 via a screw 27. Accordingly, the chain 32 impedes misplacing or losing the cover 17 after opening the audible warning device 10.

As shown in FIGS. 2–3, the preferred audible warning device 10 also has a pressure gauge 15, preferably on the top end of the tank 11. The user can then easily determine at a glance whether the tank 11 needs to be refilled or depressurized to avoid explosion.

In addition, as shown in FIGS. 2 and 5, the audible warning device 10 has an air output fitting 34, preferably on the top end of the tank. The fitting 34 is coupled to the hose fitting 38, which is in turn coupled to the hose 20. The fittings 34 or 38, or both, can have slitted threads so that the air can safely escape when uncoupling the fittings. Preferrably, a beveled rubber washer 39 is provided within the fitting 34 to reduce air leakage through the threads of the fittings.

Figure 7:
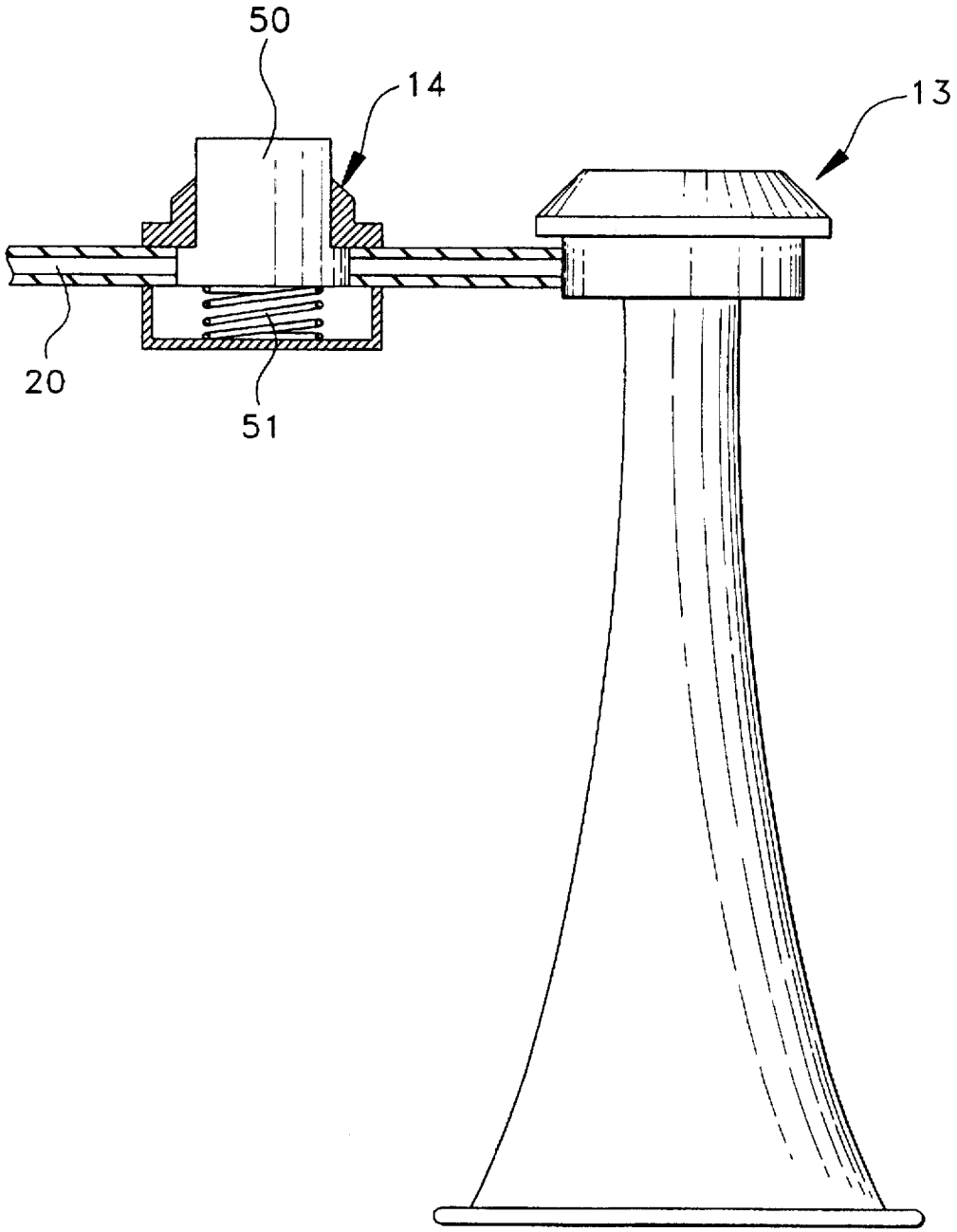
FIG. 7 is a combined front cross-sectional view of the activator and a front view of the horn of the audible warning system of FIG. 1.

As shown in FIG. 7, the hose 20 is preferably coupled to the activator 14, which is in turn coupled to the horn 13. The activator 14 can be spring loaded so that, when a user depresses the activator button 50, air escapes through the newly opened channel and into the horn 13, sounding the horn. Once pressure on the button 50 is released, the spring 51 forces the button 50 back into the closed position, thus closing the channel. Such activator may be purchased from Meade Fluid Dynamics, 4114 N. Knox, Chicago, Ill. 60641, Item Number MV-EH.

The preferred horn 13 operates as is conventionally known, wherein air is forced into a membrane (not shown) having a diaphragm (not shown) which vibrates within a chamber resulting in sounding of the horn. Such horn can be purchased from Maunco, 2655 Napa Valley Corporate Drive, Napa, Calif. 94558, Item No. 11117.

Figure 6:
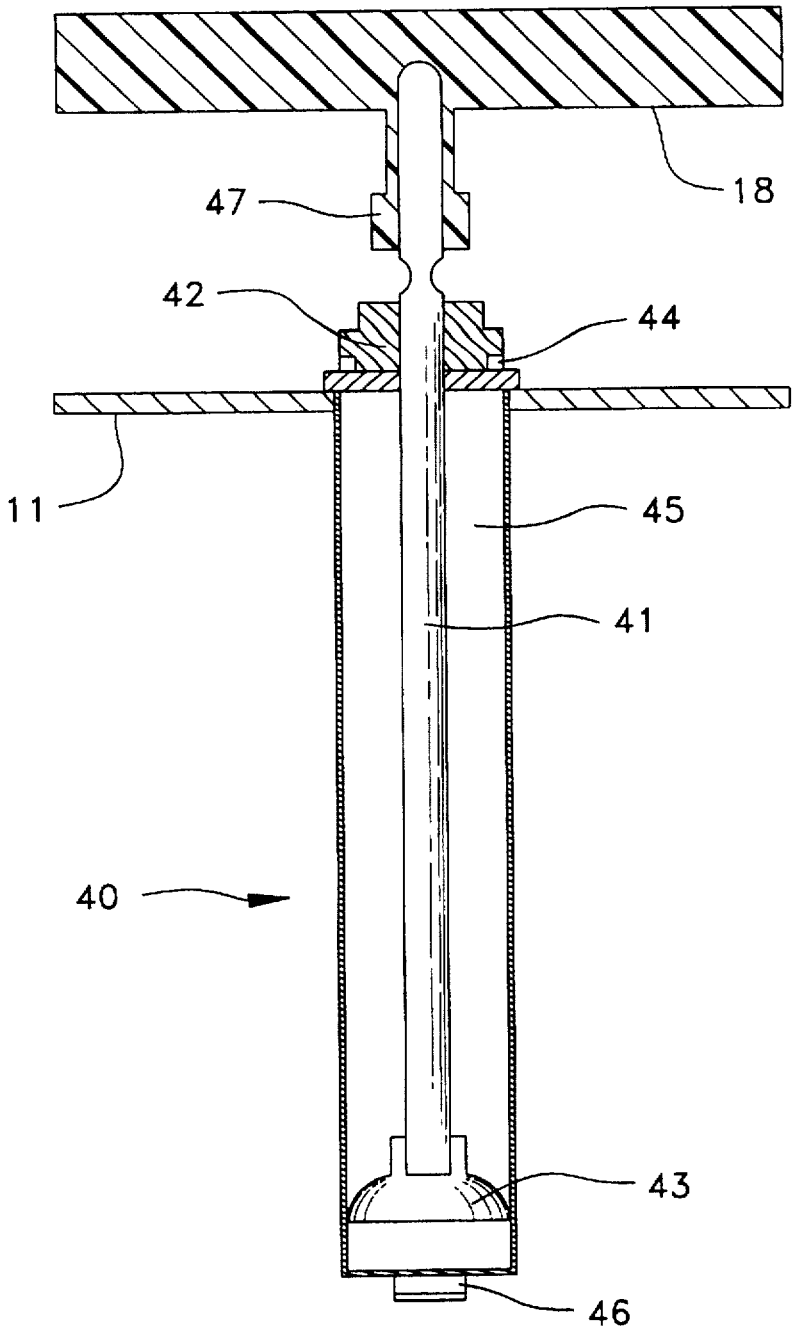
FIG. 6 is a front cross-sectional view along line 6—6 of FIG. 2.

Referring now to FIG. 6, the preferred pump 40 has several main elements: the pump handle 18, a plunger tube 41, a leather cup 43, a pump cylinder 45, and a check valve 46. Accordingly, a user can use the pump handle 18 to oscillate the plunger tube 41 (and thus the leather cup 43) within the pump cylinder 45 to force air through the check valve 46 into the tank 11. The check valve 46 preferably only allows air flow in one direction. Thus, the pressurized air in tank 11 cannot return into the pump cylinder 45 via the valve 46.

Several other elements enhance the operation of the pump 40. For example, a pump cap assembly 42 can be designed to assist the user in maintaining the side-to-side oscillation of the plunger tube 41 to a minimum, facilitating pressurization of the tank 11.

In addition, a bumper pad 47 can be provided to stop the plunger motion in order to protect the leather cup 43 and/or to cushion the impact transmitted to the user once the leather cup 43 reaches the end of the cylinder 45. It should be apparent to one skilled in the art that the bumper pad 47 can be integrated with the pump handle 18 or provided separately.

Finally, a serrated gasket 44 may be used to mate the pump cylinder 45 and the pump cap assembly 42. Because of the serrations, the gasket 44 would not ordinarily completely seal the pump cylinder 45 and the pump cap assembly 42. This could allow air to enter the pump cylinder 45. This air is then pumped into the tank 11.

It is preferable to provide a low pressure pump that cannot pump more than about 100 psi, and preferably less than 50 psi. In this manner, the tank 11 cannot be overpressurized, lowering the risk of explosion.

Persons skilled in the art may recognize other safety or comfort features that can be added to the embodiment described above, such as applying reflective tape 21 on the tank 11 to reflect light, or providing a shoulder strap 12 for carrying the audible warning device 10. Similarly, persons skilled in the art may recognize other alternatives to the means disclosed herein, such as providing the cover 17 on the side of the tank 11, attaching the pump 40 to a separate compartment within the tank's housing, or providing the relief valve 30 on the tank 11. However, all these additions and/or alterations are considered to be within the scope of the claims underneath.

We claim:

1. An audible warning device comprising:

a refillable pressurized air tank having a service port;

a cover for covering said service port;

an air pump being spaced from said service port for filling said tank with pressurized air, said pump extending at least partially into said tank;

an activator for regulating air flow from said tank;

means for connecting said tank to said activator; and a horn connected to said activator to receive at least a portion of said pressurized air so as to be activated to produce an audible warning.

2. The audible warning device of claim 1, wherein said cover comprises a relief valve.

3. The audible warning device of claim 1, wherein said cover comprises locking means for releasably locking said cover in place.

4. The audible warning device of claim 3, wherein said locking means comprises a rotatable handle.

5. The audible warning device of claim 4, wherein said cover comprises a relief valve.

6. The audible warning device of claim 5, wherein said rotatable handle triggers said relief valve when said locking means is unlocked.

7. The audible warning device of claim 1, further comprising a pressure gauge.

8. The audible warning device of claim 1, wherein said pump is a low pressure pump.

9. An audible warning device comprising:

a refillable pressurized air tank having a service port;

a cover for covering said service port;

an air pump being spaced from said service port for filling said tank with pressurized air, said air pump extending at least partially into said tank;

an activator for regulating air flow from said tank;

means for connecting said tank to said activator;

a horn connected to said activator to receive a portion of said pressurized air so as to be activated to produce an audible warning; and a relief valve for depressurizing said tank.

10. The audible warning device of claim 9, wherein said cover comprises locking means for locking said cover.

11. The audible warning device of claim 10, wherein said locking means comprises a rotatable handle.

12. The audible warning device of claim 11, wherein said relief valve is provided on said cover.

13. The audible warning device of claim 12, wherein said rotatable handle triggers said relief valve when said locking means is unlocked.

14. The audible warning device of claim 9, further comprising a pressure gauge.

15. The audible warning device of claim 9, wherein said pump is a low pressure pump.

16. A method of producing an audible warning sound comprising the steps of:

providing an audible warning device comprising a refillable pressurized air tank having a service port, a cover for covering said service port, an air pump being spaced from said service port being at least partially mounted within said air tank for filling said tank with pressurized air, an activator for regulating air flow from said tank, means for connecting said tank to said activator, a horn connected to said activator to receive a portion of said pressurized air so as to be activated to produce an audible warning;

filling said tank with pressurized air;

depressing said activator for releasing said pressurized air into said horn thereby producing said audible warning sound;

refilling said tank after said pressurized air has been at least partially depleted therefrom; and removing said cover for servicing said audible warning device.

17. The method of claim 16, further comprising the step of providing a relief valve for depressurizing said tank.

18. The method of claim 17, further comprising the step of opening said relief valve for releasing said pressurized air without producing an audible warning sound.

* * * * *